US005285751A

United States Patent [19]

Liegeois et al.

[11] Patent Number: 5,285,751

[45] Date of Patent: Feb. 15, 1994

[54] ENGINE AIR INTAKE SCREEN ASSEMBLY

[75] Inventors: David D. Liegeois, North Fond du Lac; Michael J. Dins, Sheboygan; Daniel L. Bakke, Elkhart Lake, all of Wis.

[73] Assignee: Kohler Co., Kohler, Wis.

[21] Appl. No.: 98,546

[22] Filed: Jul. 28, 1993

[51] Int. Cl.[5] ..... F01P 7/04

[52] U.S. Cl. ..... 123/41.63; 123/198 E; 123/41.7; 55/290; 55/400; 55/437

[58] Field of Search ..... 123/41.63, 41.65, 41.7; 55/290, 400, 385.3, 437

[56] References Cited

U.S. PATENT DOCUMENTS

| | | | |
|---|---|---|---|
| 2,601,907 | 7/1952 | Burrows et al. | 55/406 |
| 3,183,899 | 5/1965 | Tuggle | 123/41.65 |
| 3,252,449 | 5/1966 | Couchman, Jr. et al. | 123/41.65 |
| 3,433,206 | 3/1969 | Pennington | 123/41.7 |
| 3,994,067 | 11/1976 | Hazzard et al. | 55/385.1 |
| 4,261,302 | 4/1981 | Sheldon | 123/41.65 |
| 4,589,379 | 5/1986 | Fujikawa et al. | 123/41.49 |
| 4,838,908 | 6/1989 | Bader et al. | 55/385.1 |
| 4,841,920 | 6/1989 | Andreasson et al. | 123/41.66 |
| 4,874,411 | 10/1989 | Snauwaert et al. | 55/290 |
| 5,000,769 | 3/1991 | Raguideau et al. | 55/406 |
| 5,046,458 | 9/1991 | Kronich | 123/41.63 |

*Primary Examiner*—Noah P. Kamen

*Attorney, Agent, or Firm*—Quarles & Brady

[57] ABSTRACT

An engine air intake screen assembly having a rotating screen is provided. A blade is positioned directly under the screen to scrape accumulated debris off the inside surface of the rotating screen, and to also chop debris flowing through the screen. The screen covers an opening in a blower housing and rotates when the engine is running. In one form, a set screw allows the clearance distance between the blade and the inside surface of the rotating screen to be adjusted.

5 Claims, 2 Drawing Sheets

FIG. 1
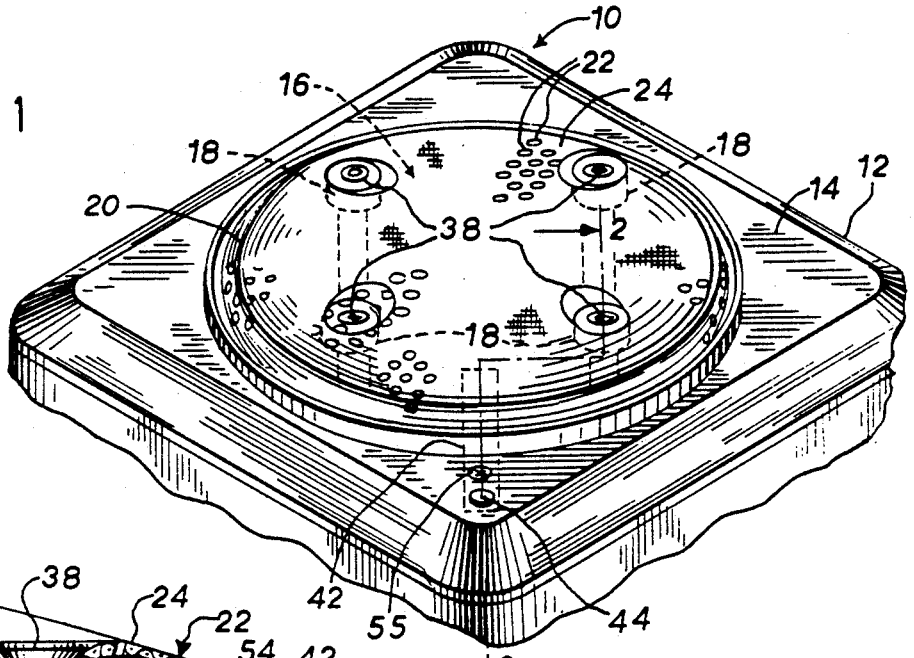
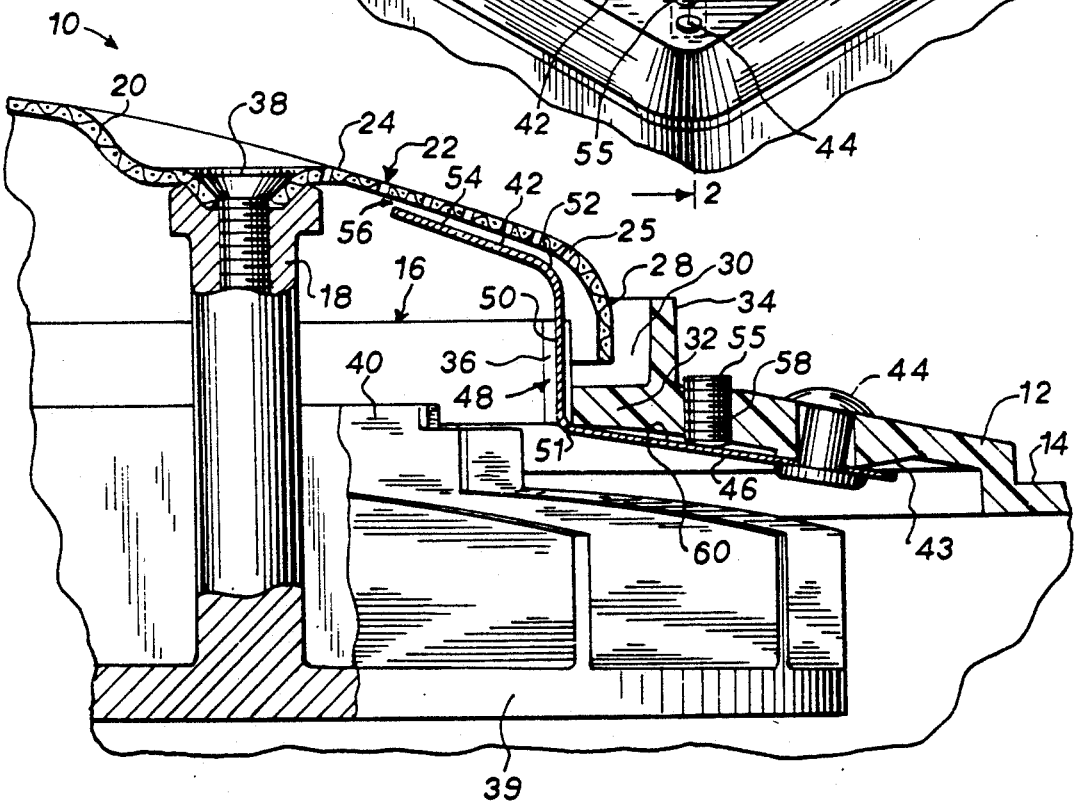
FIG. 2

ENGINE AIR INTAKE SCREEN ASSEMBLY

FIELD OF THE INVENTION

The present invention relates to internal combustion engines. More specifically, it relates to engine air intake screen assemblies that permit such engines to be used in environments where grass, straw, seeds, and other debris are prevalent.

BACKGROUND OF THE INVENTION

Internal combustion engines used on agricultural equipment (e.g. mowers) are often exposed to air that contains large quantities of foreign matter. During the normal operation of such engines, a fan draws in air for combustion and cooling purposes through an opening in an engine housing, typically called a "blower housing". Screens are typically placed over the air intake opening to reduce the amount of foreign matter that reaches the engine interior. The screens are typically designed to rotate along with the engine cooling fan so that most of the debris can be shred and shed from the screen, so that air can flow freely through the blower housing.

Even when rotating screens are used, there can still be problems caused by debris accumulating along the inside peripheral surface of the rotating screen. When debris accumulates on the inside peripheral surface of the rotating screen, the air intake inflow area is reduced.

Insufficient air flows and clogging of cooling fins can cause excessively high oil temperature, leading to lubrication quality breakdown (resulting in engine wear). Other problems can also arise, such as reduced horsepower. Compact engines with relatively small air passageways are especially susceptible to the clogging of cooling fins. It is therefore important with engines having a relatively compact cooling system, that passageways be kept as free as possible from debris so they can operate effectively.

There have been some efforts directed at preventing debris from entering the air intake opening around the peripheral edge of the rotating screen. For instance, U.S. Pat. Nos. 5,046,458 and 4,838,908. These systems make it more difficult for debris to enter around the outer peripheral edge of the rotating screen. But, improved performance is desired, especially with respect to debris collecting under the screen near the periphery of the screen.

Another approach is the rotating screen described in U.S. Pat. No. 4,589,379. There, the peripheral edge of the screen is configured to created teeth which rotate outside a rim around the inlet. Debris is cut up into fine particles as it enters the opening in the engine housing. However, the exposed teeth raise some safety concerns and provide no way to correct for wear. Further, it is still desired to reduce the amount of debris collected under the screen.

It can therefore be seen that an improved engine intake screen assembly for alleviating these problems is desired.

SUMMARY OF THE INVENTION

The present invention provides an engine air intake screen assembly with a blade to scrape accumulated debris from the inside surface of a rotating screen. The blade also chops debris entering through the screen into fine particles. The invention reduces the clogging of the inside surface of the rotating screen and clogging at the junction between the screen and housing.

In one aspect, the present invention is an air intake assembly for an engine having a shaft that rotates when the engine is running. The air intake assembly has a blower housing having an air intake opening for receiving air to cool the engine, and a fan connected to the shaft for drawing cooling air through the housing opening to cool the engine. A screen with an inside and outside surface covers the housing opening, and is connected to the shaft to rotate therewith. In this aspect, the invention provides a blade extending only partially around the air intake opening, being connected to the blower housing, and extending into the air intake opening under the inside surface of the screen at a clearance distance from the screen.

The air intake assembly of the present invention is used on an engine having a member that rotates when the engine is running, such as a flywheel. The air intake assembly has a blower housing with an air intake opening for receiving cooling air to cool the engine. A screen covers the air intake opening. A shaft is connected to the rotating member and the screen is connected to the shaft so that the screen rotates when the engine is running. A scraper blade is connected to the blower housing and extends into the air intake opening under the inside surface of the screen. As a result of this structure, debris tending to accumulate on the inside surface of the screen is scraped away and not allowed to accumulate. Also, debris coming through the screen is chopped by the blade.

Preferably, the peripheral edge of the screen extends downward and resides in an upwardly facing U-shaped groove in the blower housing. This helps prevent excessive debris from entering around the peripheral edge of the screen.

It is also preferred that the air intake assembly include a set screw for adjusting the clearance distance between the scraper blade and the inside surface of the rotating screen. The preferred set screw is located through the blower housing and presses on the top of the scraper blade to adjustably displace the scraper blade from the inside surface of the screen. Another preferred feature is providing a notch in the blower housing at the circumference of the air intake opening into which a portion of the scraper blade resides. This provides lateral support to the blade. These preferred features allow the scraper blade to operate effectively over extended periods of time.

The objects of the invention include providing an engine air intake assembly of the above kind:

(a) which is well suited for use on mowers and other agricultural equipment;

(b) which is relatively inexpensive to produce and easy to assemble;

(c) in which a scraper blade is used to inhibit debris from accumulating on the inside surface of the rotating screen, and thus maintain air flow for engine cooling;

(d) in which a scraper blade is used to chop large debris entering through the rotating screen into smaller particles and thus substantially reduce the risk of debris clogging cooling surfaces;

(e) in which the clearance between the scraper blade and the inside surface of the screen is readily adjustable so that the system can be operable over extended periods of time; and (f) in which a means is provided for maintaining the lateral position of the scraper blade during engine operation.

These and still other objects and advantages of the present invention will be apparent from the description of the preferred embodiment that follows. The preferred embodiment does not represent the full scope of the invention. Rather, the invention may be employed in other embodiments. Thus, the claims should be looked to assess the full scope of the invention.

DESCRIPTION OF THE DRAWINGS

FIG. 1 is a perspective view showing an engine air intake assembly of a preferred form of the present invention;

FIG. 2 is a sectional view taken along line 2—2 in FIG. 1;

DESCRIPTION OF THE PREFERRED EMBODIMENT

Figure 3:
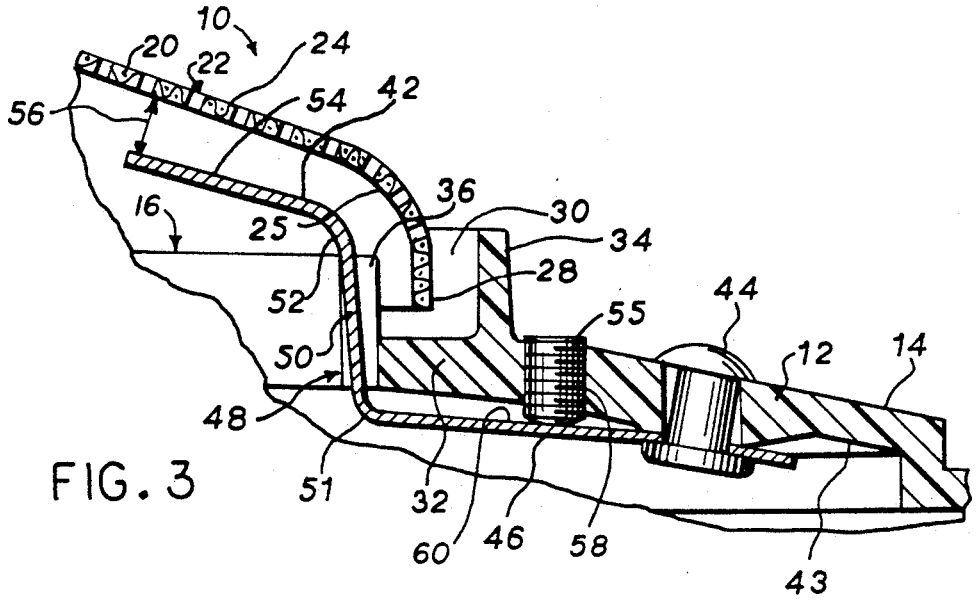
FIG. 3 is a view similar to FIG. 2, albeit showing the scraper blade of the present invention positioned farther from the rotating screen after adjustment.

Referring to the drawings, the air intake assembly 10 of the present invention is preferably used to provide cooling air to a vertical shaft engine. The air intake assembly 10 includes a blower housing 12 with an air intake port 16 through a top surface 14 of the housing 12. A screen 20 covers the air intake port 16 and is attached to four shafts 18 located within the air intake port 16. When the engine is running, a fan 40 (see FIG. 2) rotates to suck air through and around the rotating screen 20. Shafts 18 are mounted on the fan 40 (or preferably to flywheel 39) to move in unison to rotate the screen 20 when the engine is running.

Figure 4:
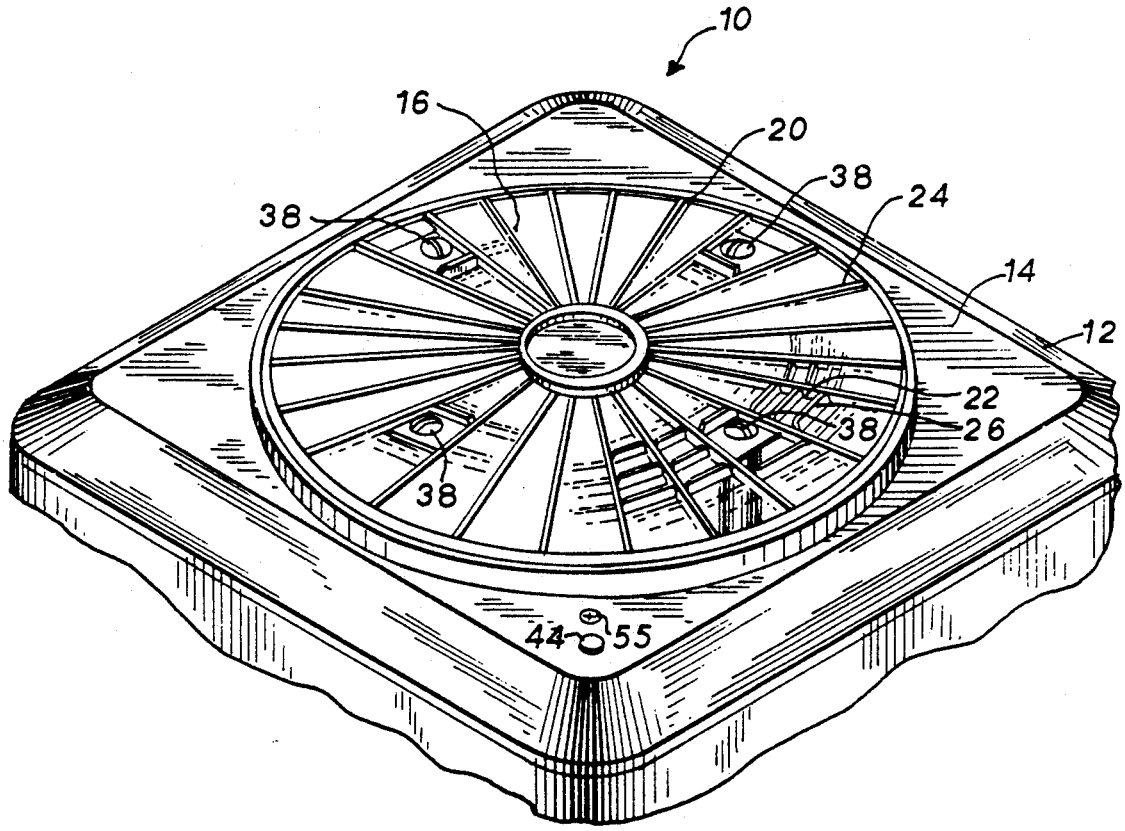
FIG. 4 is a view similar to FIG. 1 showing an engine air intake assembly with a modified rotating screen.

The screen 20 has an array of holes 22 as can best be seen in FIG. 1. Note that the screen 20 is formed in a dome shape so that the middle portion of the screen 20 is higher than the peripheral portion. Debris is shed off of the screen by centrifugal forces as debris migrates to the outer edges. This helps prevent debris from accumulating on the outside surface 24 of the screen 20 when the engine is running while cooling air is being sucked through and around the rotating screen 20. Referring to FIG. 4, staggered fins 26 can also be used to assist the screen 20 in preventing debris from accumulating on the outside surface 24.

Referring to FIG. 2, the screen 20 has a downwardly extending peripheral edge 28 that resides in an upwardly facing U-shaped groove 30 of the blower housing that surrounds the circumference of the air intake port 16. The upwardly facing U-shaped groove 30 has the blower housing 12 as its floor 32, and walls 34 and 36 as its sides. The screen 20 is attached to the shafts 18 using screws 38.

The shafts 18 are preferably integral with an engine flywheel 39 (see FIG. 2). The fan blades 40 are fixed to the top of the flywheel 39. When the engine 10 is running, the flywheel 39 rotates causing the screen 20 and the fan blades 40 to rotate. The rotating fan blades 40 draw air through and under the screen 20 into the blower housing 12 to cool the engine 10.

A scraper blade 42 is used to prevent debris from accumulating on the inside surface 25 of the screen 20 when the engine 10 is running. The scraper blade 42 is attached to the underside 43 of the blower housing 12 by a rivet 44 and extends into the air intake port 16 adjacent to the inside surface 25 of the screen 20. The blade 42 also helps to chop any large debris that sneaks through or around the screen 20.

The scraper blade 42 is preferably a piece of twice bent spring steel with a one-half inch width. It will usually not be necessary for the edges of the blade 42 to be periodically sharpened because the blade 42 is thin.

The blade 42 has two main bends 51 and 52 that separate the blade 42 into three portions: a lower attaching portion 46, an upper scraping portion 54, and an upright portion 50 connecting portion 46 and 54.

A notch 48 in the inner wall 36 of the upwardly facing U-shaped groove 30 in the blower housing 12 receives the upright portion 50 of the scraper blade 42 and helps maintain the lateral position of the scraper blade 42 against any tendency of the scraper blade 42 to rotate about rivet 44.

The distance between the upper scraping portion 54 and the inside surface 25 of the screen is referred to as the clearance distance clearance distance 56 between the upper scraping portion 54 and the inside surface 25 of the screen 20 is not necessarily constant for the entire length of the upper scraping portion 54 (although it can be). The scraper blade 42 works best when the clearance distance 56 is about $\frac{1}{8}$", but this can vary depending on operating conditions and deformations to the blade 42.

An adjustment for the blade is provided. Set screw 55 allows the clearance distance 56 to be adjusted. This allows the performance of the scraper blade 42 to be optimized, especially if the scraper blade 42 has been deformed through use.

The set screw 55 screws through a threaded hole 58 in the blower housing 12. The threaded hole 58 is located between the rivet 44 and the upwardly facing U-shaped groove 30. The set screw 55 presses on a top surface 60 of the lower attaching portion 46 of the scraper blade 42. The rivet 44 attaches the scraper blade 42 to the underside 43 of the blower housing 12 so that the lower attaching portion 46 is very close or touching the underside 43 of the blower housing 12 (see FIG. 2). The set screw 55 can, however, be screwed down to press against the top surface 60 of the lower attaching portion 46 of the scraper blade 42, and flex the scraper blade 42 so that the lower attaching portion 46 moves away from the underside 43 of the blower housing 12 (see FIG. 3). Since the notch 48 is open towards the air intake port 16, the upright portion 50 of the scraper blade 42 is free to move radially. The clearance distance 56 can therefore be adjusted by adjustably flexing the lower attaching portion 46 of the scraper blade 42 with the set screw 55.

Various modifications and variations of the preferred embodiments are within the scope and spirit of the invention and will be apparent to those reviewing this patent. For example, this invention is not limited to air cooling systems for mowers but can be useful for other engines with rotating screen air intake systems. In addition, the invention also contemplates a configuration where the lower attaching portion 46 is normally a substantial distance from the underside 43 of the blower housing 12, and a set screw with a catch at the end opposite the screwhead fastens through the lower attaching portion 46 up into the blower housing 12. With this sort of configurations, the set screw can be screwed to pull the scraper blade 42 towards the underside 43 of the blower housing 12 and thus reduce the clearance distance 56.

We claim:

1. An air intake assembly for an engine, comprising:

a shaft that rotates when the engine is running;

a blower housing having an air intake opening for receiving cooling air to cool the engine;

a fan connected to the shaft for drawing cooling air through the air intake opening to cool the engine;

a screen having an inside and outside surface, the screen covering the air intake opening, the screen being connected to the shaft to rotate therewith; and a blade extending only partially around the intake opening, being connected to the blower housing, and extending into the air intake opening under the inside surface of the screen at a clearance distance from the screen so as to be capable of scraping debris from the screen when the engine is operating in a debris containing environment.

2. An air intake assembly as recited in claim 1, further comprising:

a means for adjusting the clearance distance.

3. An air intake assembly as recited in claim 1, further comprising:

a set screw for adjusting the clearance distance between the blade and the inside surface of the screen.

4. An air intake assembly as recited in claim 3 wherein the air intake opening has a perimeter with a notch in which a portion of the blade resides.

5. An air intake assembly as recited in claim 1, wherein:

the screen has a downwardly extending peripheral edge; and the blower housing has an upwardly facing U-shaped groove in which the downwardly extending peripheral edge of the screen resides.

* * * * *